US008911340B2

(12) United States Patent
Zhang et al.

(10) Patent No.: US 8,911,340 B2
(45) Date of Patent: Dec. 16, 2014

(54) AIR PACKAGING DEVICE PRODUCT AND METHOD FOR FORMING THE PRODUCT

(76) Inventors: Jiaying Zhang, Shanghai (CN); Yaopeng Zhang, Shanghai (CN)

( * ) Notice: Subject to any disclaimer, the term of this patent is extended or adjusted under 35 U.S.C. 154(b) by 457 days.

(21) Appl. No.: 13/134,074

(22) Filed: May 27, 2011

(65) Prior Publication Data

US 2011/0230322 A1 Sep. 22, 2011

Related U.S. Application Data

(63) Continuation of application No. 12/350,277, filed on Jan. 8, 2009, now Pat. No. 8,016,110.

(51) Int. Cl.
*B31B 1/64* (2006.01)

(52) U.S. Cl.
USPC ..... 493/189; 493/464

(58) Field of Classification Search
USPC ..... 493/189, 207, 967, 480, 464
See application file for complete search history.

(56) References Cited

U.S. PATENT DOCUMENTS

| | | | | | |
|---|---|---|---|---|---|
| 4,874,093 | A * | 10/1989 | Pharo | 206/522 |
| 5,263,587 | A * | 11/1993 | Elkin et al. | 206/522 |
| 5,826,723 | A * | 10/1998 | Jaszai | 206/522 |
| 6,283,296 | B1 * | 9/2001 | Newman | 206/522 |
| 7,568,508 | B2 * | 8/2009 | Liao et al. | 141/114 |
| 2005/0109656 | A1 * | 5/2005 | Ishizaki | 206/522 |
| 2007/0051656 | A1 * | 3/2007 | Hsin | 206/522 |
| 2011/0211774 | A1 * | 9/2011 | Zhang et al. | 383/3 |
| 2011/0226657 | A1 * | 9/2011 | Zhang et al. | 206/522 |

* cited by examiner

*Primary Examiner* — Sameh H. Tawfik
(74) *Attorney, Agent, or Firm* — Raymond Y. CHan; David and Raymond Patent Firm

(57) ABSTRACT

An air packaging device includes two layers of thermoplastic films, which form a sealable space where air is filled after first and second steps of heat-sealing process. The sealable space includes a number of independent sealed air chambers and a main air passage channel. The main channel has an air inlet. Each sealed air chamber is connected with the main channel by at least one one-way valve each including at least two layers of plastic films. At least two one-way valves are installed inside of the air chambers. This air packaging device increases the cushioning protection where the protection is most needed, but can reduce air chamber dimension at less important locations in order to reduce the volumetric size and, hence, reduce the shipping cost.

25 Claims, 13 Drawing Sheets

AIR PACKAGING DEVICE PRODUCT AND METHOD FOR FORMING THE PRODUCT

CROSS REFERENCE OF RELATED APPLICATION

This is a Continuation application that claims the benefit of priority under 35 U.S.C. §119 to a non-provisional application, application Ser. No. 12/350,277, filed Jan. 8, 2009 now U.S. Pat. No. 8,016,110.

BACKGROUND OF THE PRESENT INVENTION

1. Field of Invention

The present invention provides a technical method to create a three-dimensional air sealable packaging material by using a self-adhesive non-reversible air blockage technique (one way valve) and multi-layered functional polyethylene soft plastic resins. This material can be used in areas such as consumer electronics, glassware, high precision instruments and meters, art crafts, printer cartridges and products that are fragile, have high consumer values and require high safety protection performances. The present invention integrates multiple functions such as for direct load resistance, for anti-vibration, for being sealable, for anti-humidity, and for good shock resistance, provides good protective performance and, yet, is considered environmental friendly packaging material. It can be used in product protection, space void filling, and product area protection or used as protective isolator cushions during shipping. Most importantly, it can also be designed as printable and, hence, can be directly used as sales packaging combining with protective performance.

2. Description of Related Arts

Globalization has increased the distance between product manufacturing and the product consumer market, and this trend has pushed the fast development of protective packaging in order to meet long distance protection shipping needs. Traditional Expanded Polystyrene (EPS) and Expanded Polyethylene (EPE) products are only shipped to users after foam molding or processing at the supplier's factory location. The formed, finished, EPS products are large in size and very inconvenient for transportation and storage. On-site foaming materials developed for convenience of transportation mainly use polyurethane foaming plastic materials to expand around the content article and form the protective mould around it. However, it is expensive to use and requires on-site equipment to process. That it also needs skilled workers as well as the working load makes it impossible for application for large scale product lines such as those for electronic products. Most importantly, the drawbacks of the Expandable Polystyrene products have caused many environmental concerns, and it is becoming the "white pollution" of this century. Considering the fact that protective products made of EPS material are used in a very short time span between manufacturing, shipping, and warehousing for commercial sales and finally to the consumer, EPS products are non-recyclable after use, and it is non-degradable lasting for hundreds of years once it is formed. The large volume of EPS packaging wastes has caused tremendous environmental damage. Incineration causes toxic gas to the atmosphere, and sending to a waste land fill will shorten the usage design of the waste land fill because these EPS products can not be decomposed for hundreds of years. With increasing concerns about environmental pollution issues, the development of this foam plastic material is greatly restricted by governmental regulation and public attentions. At the same time, products available to the protective packaging market are all limited by the large space volume needed to ship and to warehouse these packaging material. Shipping costs and warehouse handling costs have limited the sales of these products to within a short sales diameter distance. Hence, the present invention has focused on creating a marketable product that is easy for long distance transportation, on-site rapid formation, and good protective performance and, yet, that is of great benefit to the environment.

With the rapid development of soft plastic material, more and more industries can benefit from the design and functional expendability by utilizing the properties of this material. Traditional air filling packaging generally uses a heat sealing technique to form simple round shape air bubbles (BUBBLE WRAP), blocks or columns. The bubble wrap can be transported in rolls. However, products in other shapes request the installation of complex heat-sealing equipment on site to produce the product. As the protective effects and the transforming shapes of such products are limited, they are often used as padding or for filling space only. At the same time, air cannot be kept inside for a long time due to the unstable heat sealing quality when produced on site. Therefore, the development of packaging products using air as cushioning media has long been limited.

Literature, such as Walker (1981, U.S. Pat. No. 4,191,211) and Koyanagi (1987, U.S. Pat. No. 4,708,167), has recorded the use of valve structures made of soft plastic material such as rubber or latex. This valve material can be used in designs such as water bags, coffee bean bags and balloon toys. This soft plastic valve can provide a passage for air or liquid to enter but prevents the leakage of air and liquid. On the basis of such theory, using different materials may be applicable in different areas such as life-saving jackets and sealed devices to keep liquids in the bladder. In 2005, Fu Jinfang in "Packaging Engineering" and Liu Gong in "Packaging and Food Machinery" published articles on the feasibility study of using air for cushioning, providing the present invention a very good theoretical basis.

China's Patent Application No. 200510025833.4 published in Nov. 22, 2006 demonstrated an air packaging material and its production method by using a self-adhesive, non-reversible, air blockage technique. Such packaging material, comprising 4 layers of plastic films, formed a space for air storage by heat-sealing at specified locations. Air can be preserved in the space in a long-lasting manner utilizing both the self-adhesive film and the function of air pressure. Air and soft plastic film form a functional material that could be designed to have different functions such as shock-resistance, compression-resistance and moisture blockage.

China's Patent Application No. 200580016507.5 published in Nov. 21, 2007 demonstrated an air packaging device structure with improved shock absorption performance for the protection of products inside the container case. The air packaging device comprises first and second plastic films, adhered by heating at prefabricated locations to produce a number of air chambers. Each air container has a number of serially connected air chambers. A number of one-way valves established at the entrances of the corresponding air containers allow pressurized air to move forward. The air inlet is publicly connected with the one-way valves. Heat-sealing protrusions are formed at the lateral edges of the air packaging device. The prefabricated points of the air container are adhered to the heat-sealing edges. Thus, the open-mouth container part is created, which will wrap the product inside and which has the padding part in support of the container part when the air packaging device is filled with pressurized air.

The air packaging device published by the above Chinese patent applications is as illustrated in FIG. 1. Air, through the main channel 1 and the one-way valve 2, gets into air chambers 3. The air chambers 3 are roughly the same in diameter, and the maximum load bearing is uniformly distributed throughout the surface area. When the packaged object falls, all the air chambers are impacted simultaneously, which is the same as a flat surface. In this case, the pressure that can be withstood is relatively small, and the cushioning effects are not very satisfactory.

On the other hand, after filling with air, the size of the object that can be contained in the internal space is basically defined. If the article is too big in size, it cannot be placed inside the air packaging device. On the contrary, if the article is too small in size, the article may be subject to motion and shock and may pierce of the air packaging device, resulting in the failure of the cushioning protection. In case of articles for packaging with slight differences in size (such as 14 inch and 15 inch laptop computers), two sets of production techniques and moulds are required, leading to greater production costs. Meanwhile, increasing packaging volume will increase transportation costs and will greatly increase the costs for end products in the case of globalized purchase, manufacturing, transportation and sales.

The present invention is therefore intended to obviate or at least alleviate the problems encountered in the prior art.

SUMMARY OF THE PRESENT INVENTION

To solve the above problem, the present invention provides an air packaging device with greatly enhanced cushioning effects applicable in packaging of articles of various sizes. The packaging device can reduce the volume of the packaged articles and, thus, can greatly cut down transportation costs.

To achieve the above objectives, the present invention takes the technology program as follows:

An air packaging device includes two layers of thermoplastic films. After two steps of heat sealing, the thermoplastic films form a space to store air, which space includes a number of independent sealed air chambers and one main channel. The main channel has an air inlet. Each sealed air chamber is connected with the main channel by a one-way valve made of at least two layers of films. It is featured that parts or all the air chambers are installed with two or more one-way valves.

Load carrying capacity increases as the diameter of the air chamber increases, which means better protective effect. Therefore, increasing the air chamber diameter in a limited space can improve the load carrying capacity of the air packaging device. However, the increased air chamber diameter takes a long time to fill with air, which may affect the packaging working time needed. Therefore, installation of at least two one-way valves in an air chamber of a relatively larger diameter will solve the problem of the air filling time.

The sealed air chambers have different main diameters.

Due to the different main diameters of the air chambers, after being filled with air, the air chambers with a larger main diameter and the air chambers with a smaller main diameter on the same surface will take wave-like shapes just like a corrugated paper structure of the packaging cartons, to greatly improve the carrying capacity of the packaging device.

A larger air chamber diameter makes a larger carrying capacity, which means better protective effect. Therefore, increasing the air chamber diameter in a limited space can improve the load carrying capacity of the air packaging device to achieve better protective effects. However, due to the limited space, the main diameters of air chambers in some major areas are increased to improve the load carrying capacity therein while the main diameters of the air chambers in less important areas are reduced correspondingly. Another main purpose to increase the air chamber diameter only in most important areas is to reduce the packaging volume. Increasing cushioning in major areas and reducing the air chamber diameters in areas requiring less protection can effectively reduce the volume to cut down transport costs correspondingly. The volume will be large if all the air chambers are the same in size.

Preferably, the large and small air chambers of the packaging device are alternatively distributed. Such structure, after being filled with air, the large and small air chambers will take on wave-like forms with only the air chambers of a larger diameter in touch with the article being wrapped. Like corrugated paper packaging, its own load carrying capacity is larger than if in touch with the basic plane formed by air chambers with the same diameter.

Preferably, the packaging device is a rectangle bag with opening at one end.

In this way, two packaging devices are required to wrap both sides of the article respectively. Then, the packaging device is applicable only if one side of the rectangle article is suitable in measurements, making the range of application relatively wide.

Preferably, the packaging device is bag-shaped.

The bag-shaped packaging device is suitable for articles of relatively higher packaging requirements to provide good all-around protection for the articles.

Preferably, the main diameters of the air chambers at both sides of the packaging device are relatively small, while the main diameter of the air chamber at the middle is relatively large.

Preferably, the one-way valves sealed by heat plastic packaging may be used in one or more air chambers of a relatively small main diameter to block the air incoming channel therein.

In this way, on the basis of the original products, adding a working procedure of plastic heat sealing of the small air chambers around the lateral pressurized air chamber will obtain a packaging device for articles in other measurements without the need for a new mould, greatly cutting down production costs. In addition, the working procedures may be adjusted from time to time according to demands, satisfying the actual needs and cutting down inventories.

A packaging device production method, including a first step plastic heat sealing and a second step plastic heat sealing, is featured that the first step plastic heat sealing includes the following steps:

A first heat sealing process produces semi-finished packaging products having air chambers with a number of one-way valves installed, and the semi-finished products are then stored in rolls for future use.

The above semi-finished products undergo a second time heat sealing process by going through a one-step plastic heat sealing machine, further dividing some air chambers with multiple one-way valves into independent, small-diameter air chambers or connected spaces as required.

Using the production method of the present invention, a one-step plastic packaging machine may be employed in preparation to process first step semi-finished products with a number of one-way valves of a large air chamber diameter of various universal standards. When receiving orders, directly process partition lines on the prepared semi-finished products divide the large air chambers into independent, small air chambers. With preparation in spare time, the efficiency of one-step plastic packaging production will be greatly improved when having orders, resulting in greatly improved production of finished products. This will also make it convenient for factories in making production arrangements.

Using the on-site direct forming method can greatly reduce the package volume and, hence, the transportation costs, solving the problem of excessively high costs of long distance transportation of packaging materials. The products are made completely flat prior to use by using flexible plastic materials and prefabricated design. When using the products, such materials will be formed rapidly by air and will form a protective structure around the article to be protected. Comparing with existing technologies, the three-dimensional air packaging material of the present invention has excellent comprehensive protection functions such as anti-resistance, anti-vibration, anti-compression and cushioning. It can be used for padding packaging of articles, partition boards for local or major areas of articles, and the overall external packaging for articles.

The present invention will become clearer in light of the following detailed description of illustrative embodiments of this invention described in connection with the drawings.

BRIEF DESCRIPTION OF THE DRAWINGS

The present invention will be described via detailed illustration of the preferred embodiments referring to the drawings.

DETAILED DESCRIPTION OF THE PREFERRED EMBODIMENTS

The air packaging device of the present invention will be more readily understood upon a further deliberation of the following detailed descriptions of the preferred embodiments of the present invention with reference to the accompanying drawings.

A first step heat sealing refers to forming a plane bag for air storage by heat sealing treatment of two layers of thermoplastic films and a one-way valve. A second time heat sealing process refers to forming a three-dimensional bag for storage by folding a semi-product obtained from the first step heat sealing and, then, further heat sealing along a heat sealing line for the second time heat sealing process.

Figure 1:
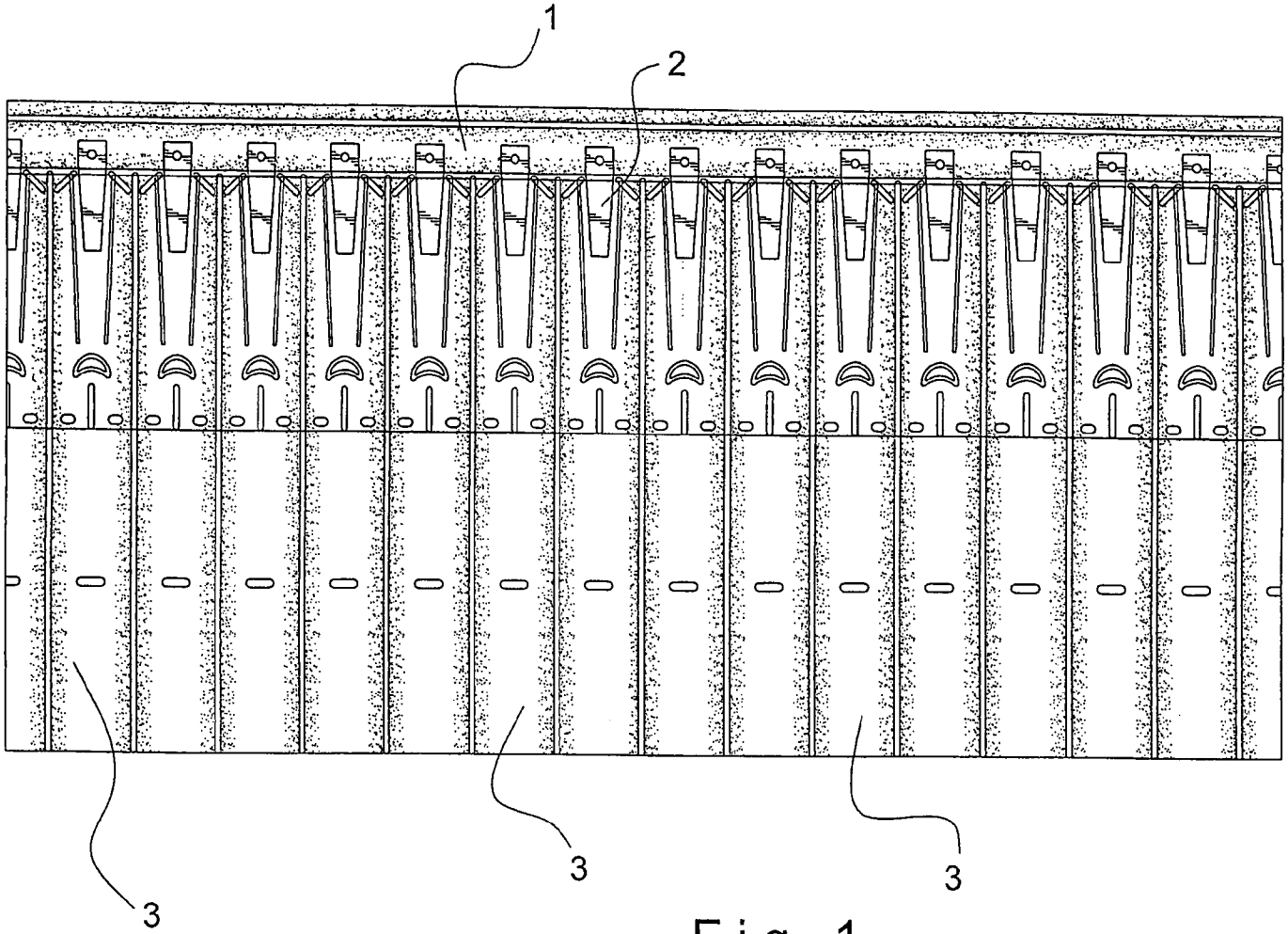
Fig. 1 PRIOR ART
FIG. 1 is a perspective view of a conventional air packaging device.
Figure 2:
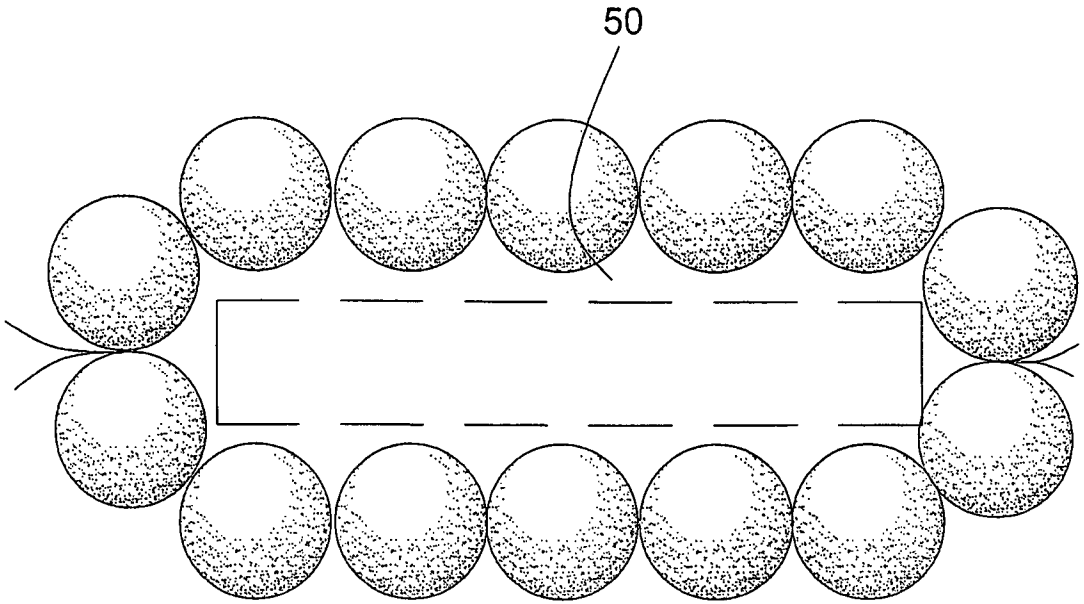
Fig. 2 PRIOR ART
FIG. 2 is a cross-sectional view of the conventional air packaging device and an article contained with the air packaging device in FIG. 1.
Figure 3:
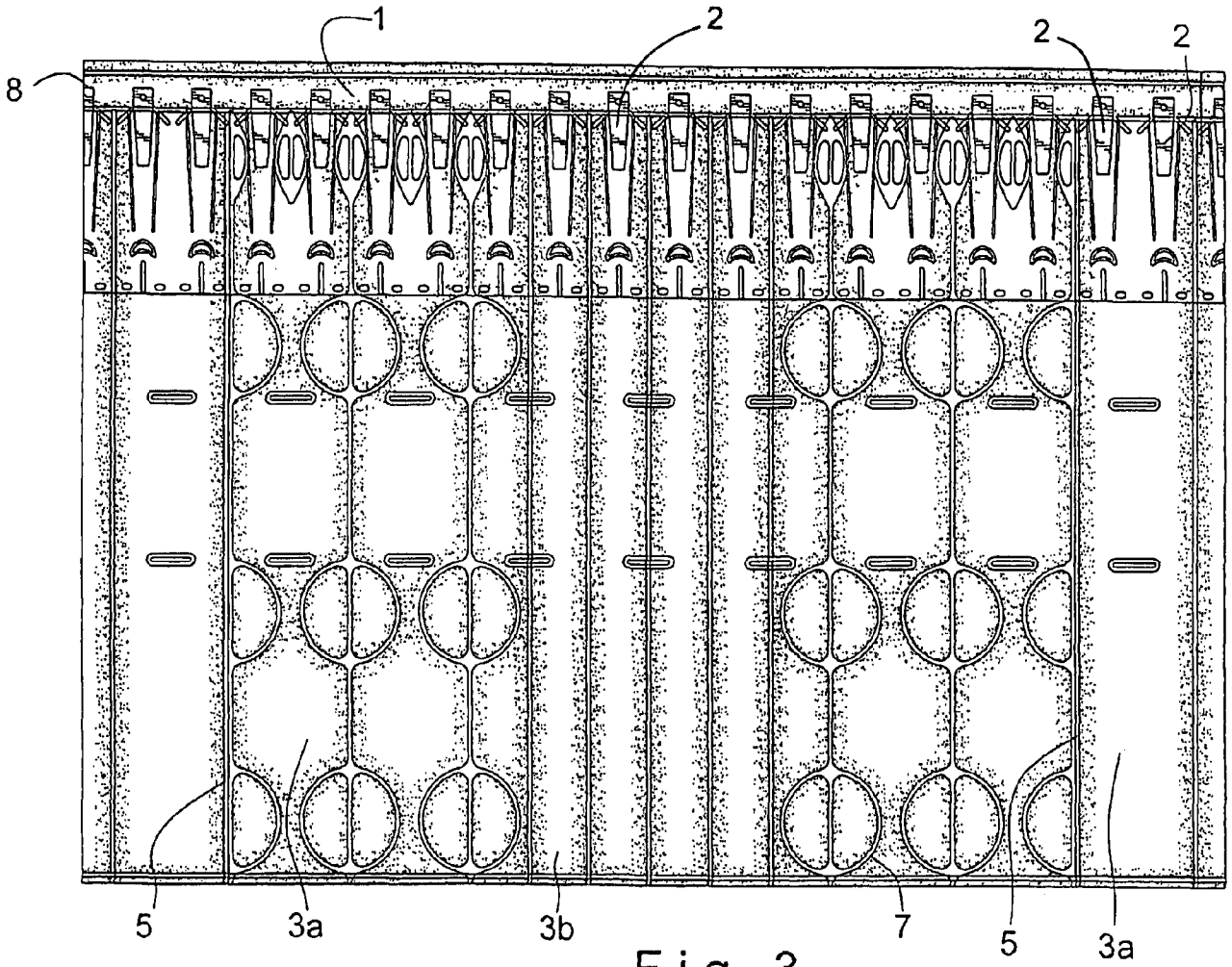
FIG. 3 is a perspective view of an air packaging device in accordance with a first embodiment of the present invention in a state prior to the second step heat-sealing process.

FIG. 3 depicts an embodiment of the air packaging device of the present invention before going through the second step heat sealing process. It differs from the existing technology in: first, the main diameters of the air chambers 3*a* at both sides are the same and are larger than the diameter of the air chambers 3*b* in the middle; secondly, each side air chamber 3*a* is connected with a main channel 1 with two one-way valves 2, but each middle air chamber 3*b* is only installed with one air valve 2; and thirdly, the heat sealing line 5 created by the second step heat sealing is the sealing line between the first and second air chambers 3*a* at both sides, making the first air chamber 3*a* at each of both sides a side pressure chamber for lateral cushioning. During the second step heat process, the end of the main channel 1 of the semi-finished product depicted in FIG. 3, is closed and wrapped upward, similarly to FIG. 7, and the upper and lower parts of FIG. 3 along the heat sealing line 5 are heat sealed, to form a bag with an upper opening. When using on site, air is filled into each air chamber 3*a*, 3*b* through an inlet 8 of the main channel 1, and, then, the article 50 is wrapped at both ends by two such packaging devices for packaging. Installing two one-way valves 2 in one air chamber 3*a* makes it easy to increase the air chamber diameter, and the carrying capacity of the air chamber 3*a* is increased correspondingly. The diameters of air chambers 3*a* at both sides are larger than the diameter of the air chambers 3*a* in the middle, which is similar to the internal structure of alternatively distributed small and large air chambers depicted in FIG. 9. The contact surface in between the air chamber and the article 50 will take a wave-like form in structure similar to corrugated paper. This will greatly increase the carrying capacity of the packaging device in accordance with physics theory. Meanwhile, the design of the heat sealing line 5 during the second step heat sealing process on the sealing line of the first air chambers 3*a* at both sides (i.e. the left and right side pressure chambers 3*a*) and the second air chamber will protect the article 50 in all aspects as the side pressure air chambers 3*a* have the lateral cushioning effects.

Figure 4:
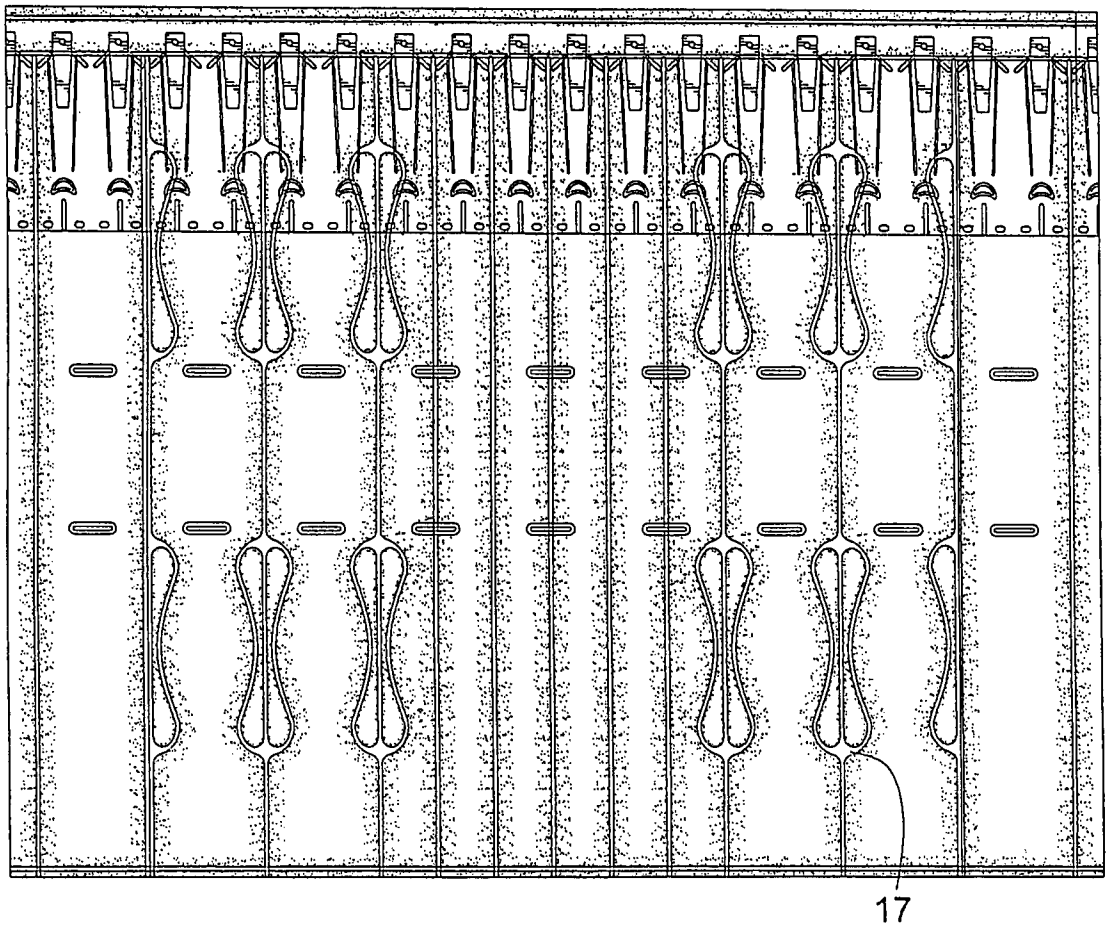
FIG. 4 is a perspective view of an air packaging device in accordance with a second embodiment of the present invention in a state prior to the second step heat-sealing process.

FIG. 4 depicts a second embodiment of the air packaging device of the present invention before going through the second step heat sealing process. It differs from the first embodiment in using purposely designed heat sealing lines of different shapes. FIG. 3 adopts the round shape heat sealing line 7 while FIG. 4 adopts a figure 8-shaped heat sealing line 17. The heat sealing line will form one or more closed spaces. The air cannot penetrate into the enclosed air chamber but inflates air chambers 3*a*, 3*b* around these closed spaces. The sealed space is protected by the surrounding air chambers 3*a*, 3*b* and is free from external impact, being applicable to articles with parts of relatively higher requirements regarding impact.

Figure 5:
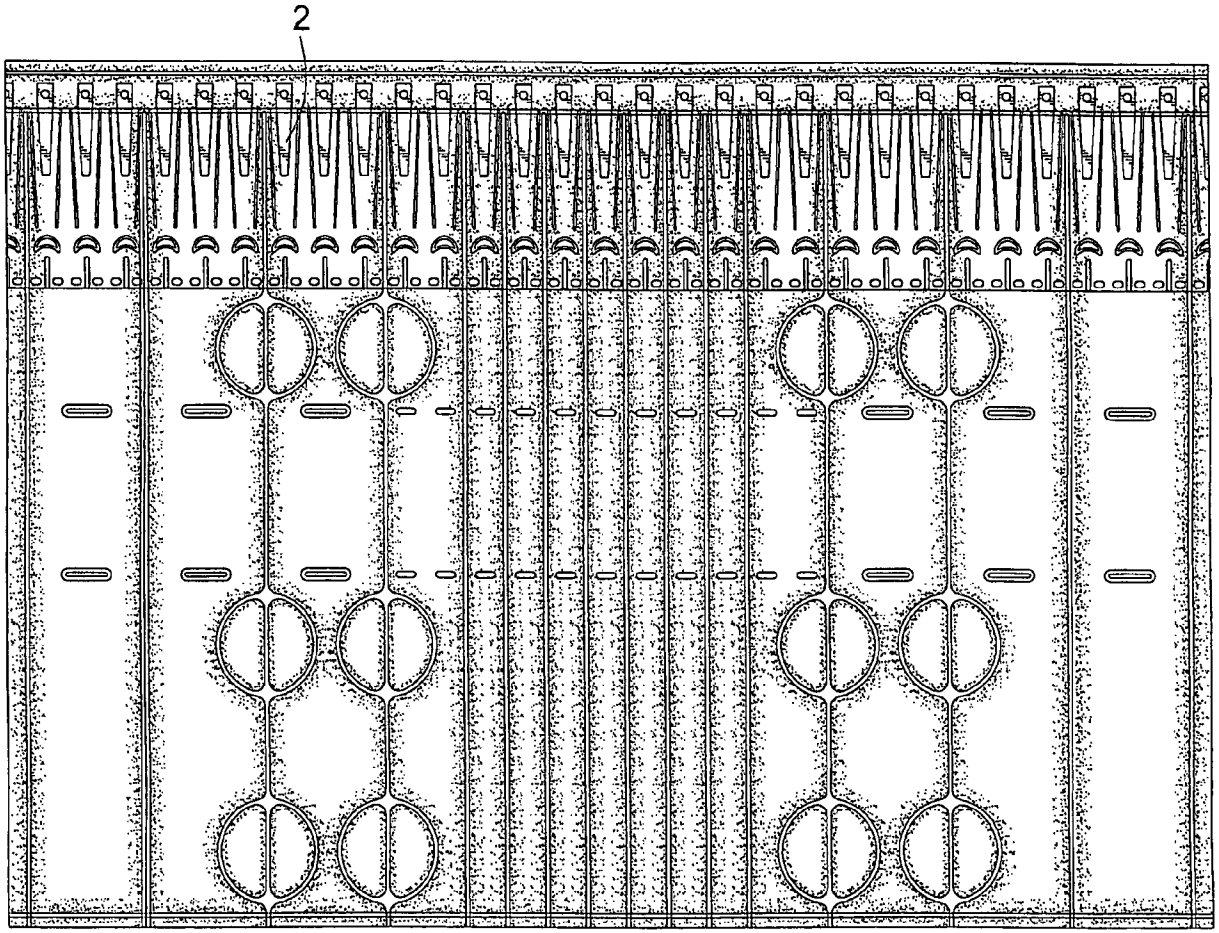
FIG. 5 is a perspective view of an air packaging device in accordance with a third embodiment of the present invention in a state prior to the second step heat-sealing process.

FIG. 5 depicts a third embodiment of the air packaging device of the present invention before the processing the second step heat sealing process. It differs from the first embodiment in: the diameters of the air chambers at both sides are larger and are provided with three one-way valves 2.

The increased main diameters of the air chambers at both sides will improve the maximum carrying capacity of the air chambers.

Figure 6:
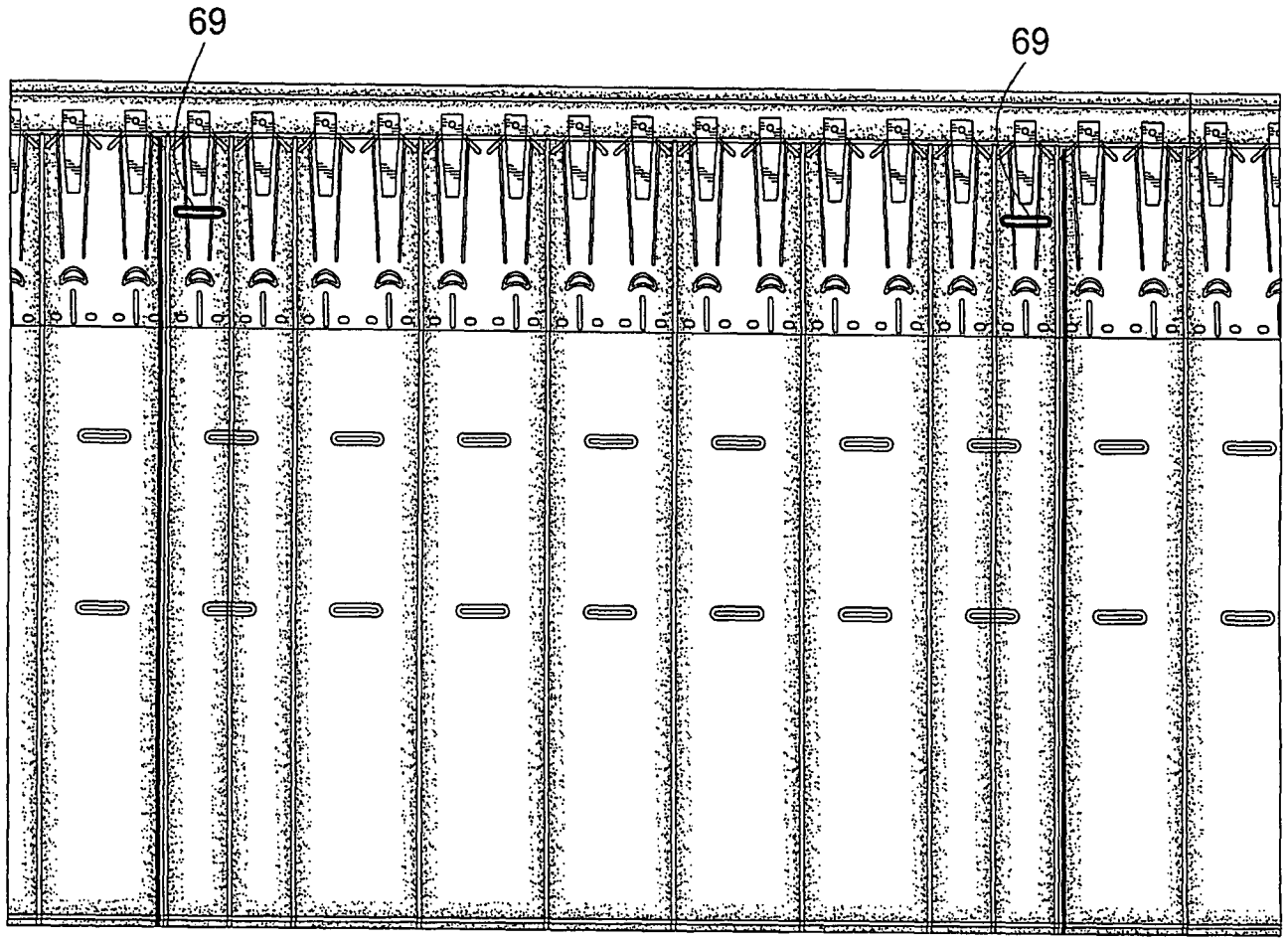
FIG. 6 is a perspective view of an air packaging device in accordance with a fourth embodiment of the present invention in a state prior to the second step heat-sealing process.
Figure 7:
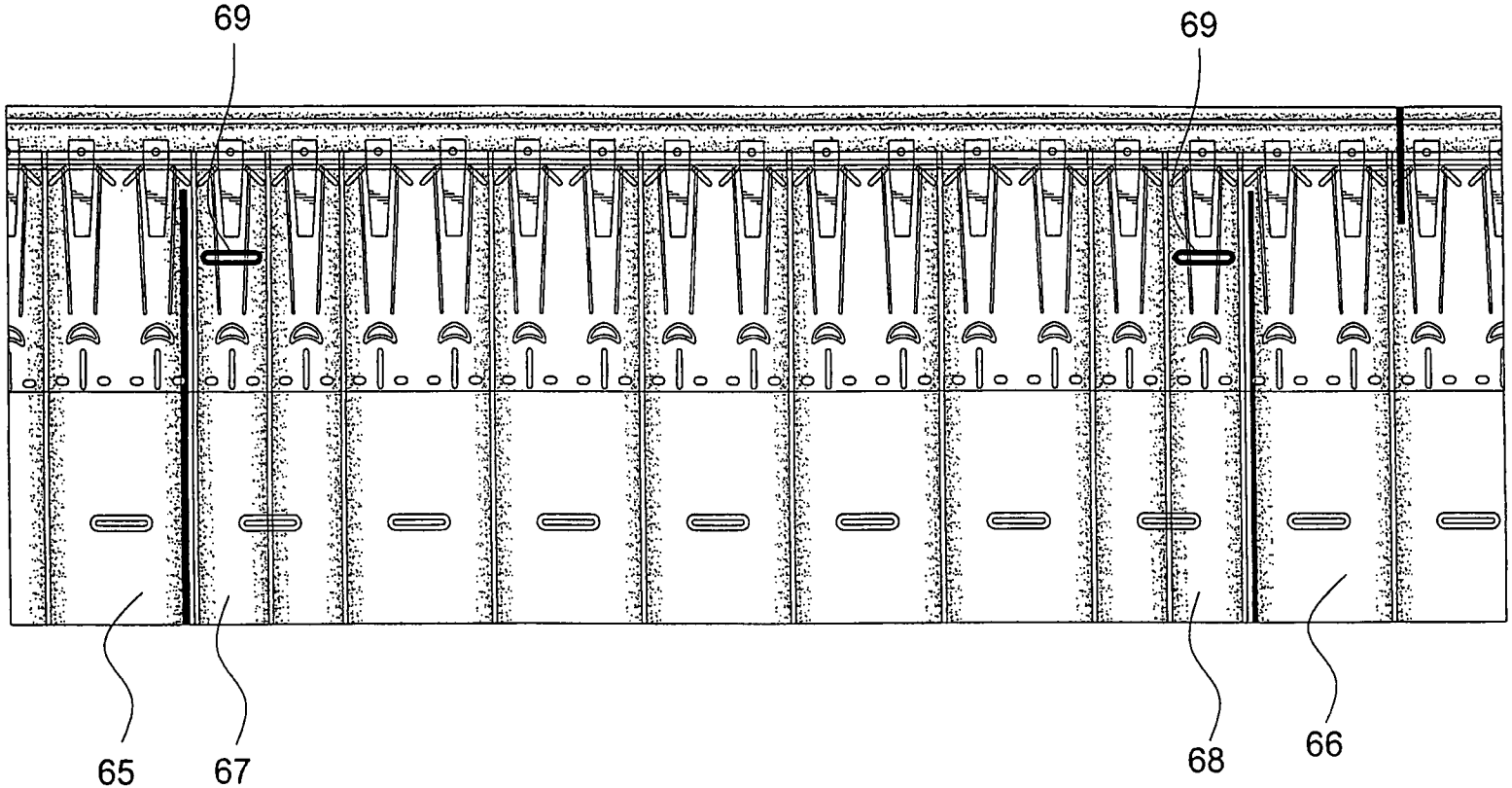
FIG. 7 is another perspective view of the air packaging device in FIG. 6 after folding and the second step heat-sealing process, illustrating a plurality of heat-sealing lines on the air packaging device.

FIG. 6 and FIG. 7 depict a fourth embodiment of the air packaging device. FIG. 6 depicts the air packaging device before processing the second step of heat sealing procedure and FIG. 7 depicts the air packaging device after the second step of heat sealing procedure. They differ from the previous three embodiments in: two small main diameter air chambers 67, 68 are next to the first air chambers at both sides, namely, the left pressure air chamber 65 and the right pressure air chamber 66. Between the air chambers 67 and 68, there are a number of air chambers of the same diameter as the left and right side pressure air chambers 65 and 66. There is a heat sealing line 69 on the one-way valves of the small diameter air chambers 67 and 68 next to the left and right side pressure air chambers 65 and 66, sealing off the one-way valves of the air chambers to make it unable to fill with air. After air inflation, its horizontal length is slightly larger than the length when all the air chambers are filled with air for packaging devices with variations in length such as the 14 inch and 15 inch laptop computers. As large diameter air chambers are on both sides of the small diameter air chambers, it bears on pressure of impact. The cushioning protection of the packaging device will not be affected if the small diameter air chambers are not filled with air. In this way, adding a working procedure of plastic packaging of sealing off the one-way valve of the small air chambers can produce packaging devices of two specifications. As no new moldings are needed, the production costs will be cut down greatly, and the products on the production line can be modified at any time in line with production without excessively more inventories.

The number of the small diameter air chambers can vary according to the actual design. The sealed air chamber can be one or more according to the actual situation.

Figure 8:
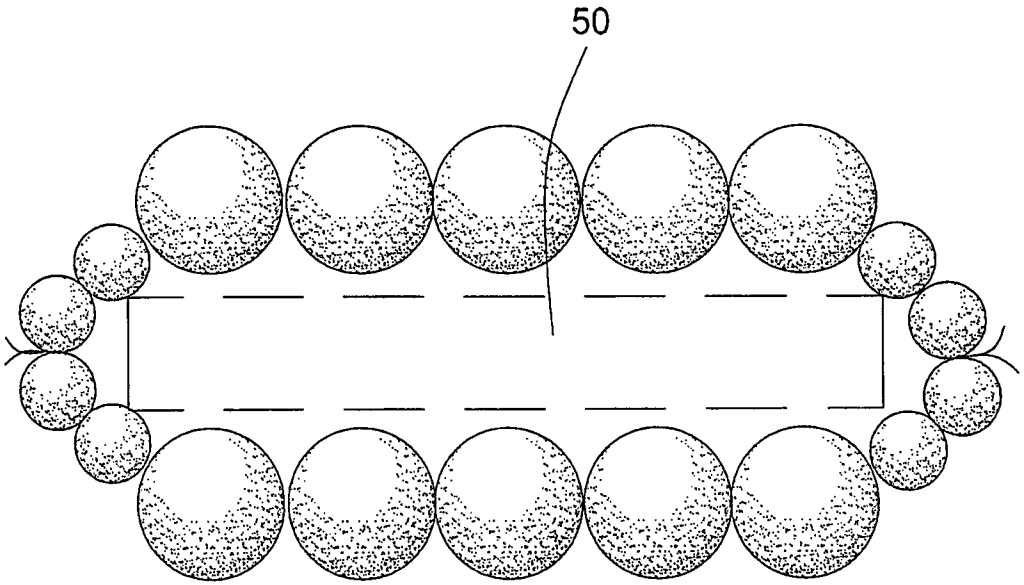
FIG. 8 is a cross-sectional view of the air packaging device and an article contained with the air packaging device in accordance with the present invention.
Figure 9:
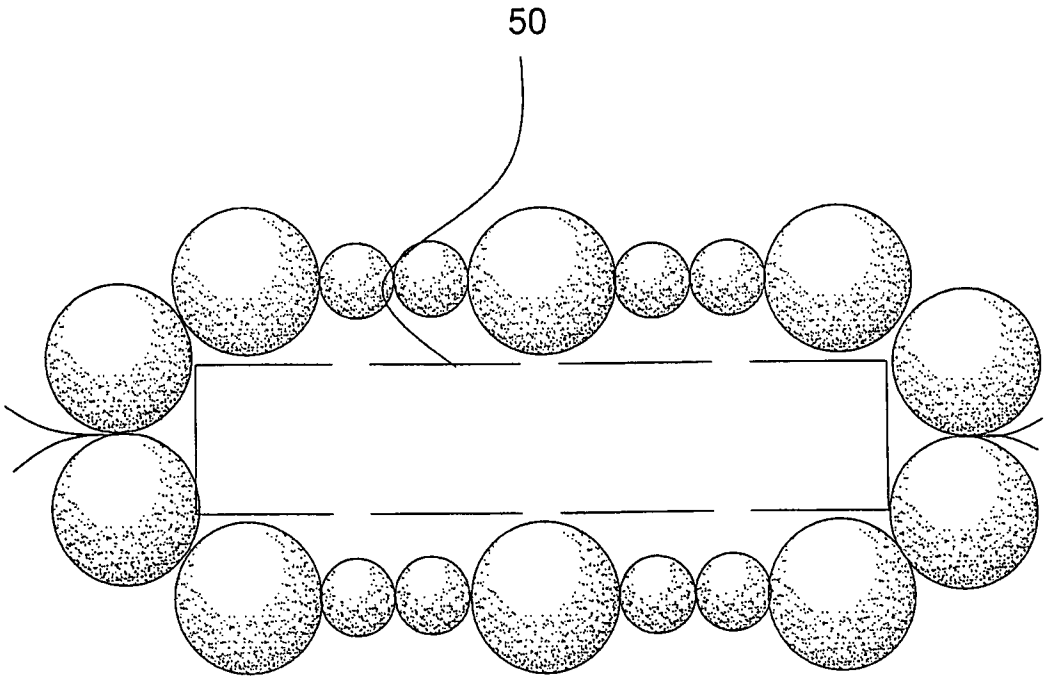
FIG. 9 is a cross-sectional view of the air packaging device and an article contained with the air packaging device in accordance with the present invention.

More importantly, as depicted in FIG. 8 and FIG. 9, in case of packaging devices with the same measurements, the one with small-diameter air chambers around the heat sealing line after the second step heat sealing process can contain an article 50 of large volumetric size than the one contained in the packaging device with equal size diameter air chambers. Adding cushioning in major parts and cutting down the air column size in areas without need of protection can effectively reduce volume and transportation costs. Although the volume reduction of single packaging is limited, the saved transportation costs will be considerable in case of a large batch of products for long distance transportation.

Figure 10A:
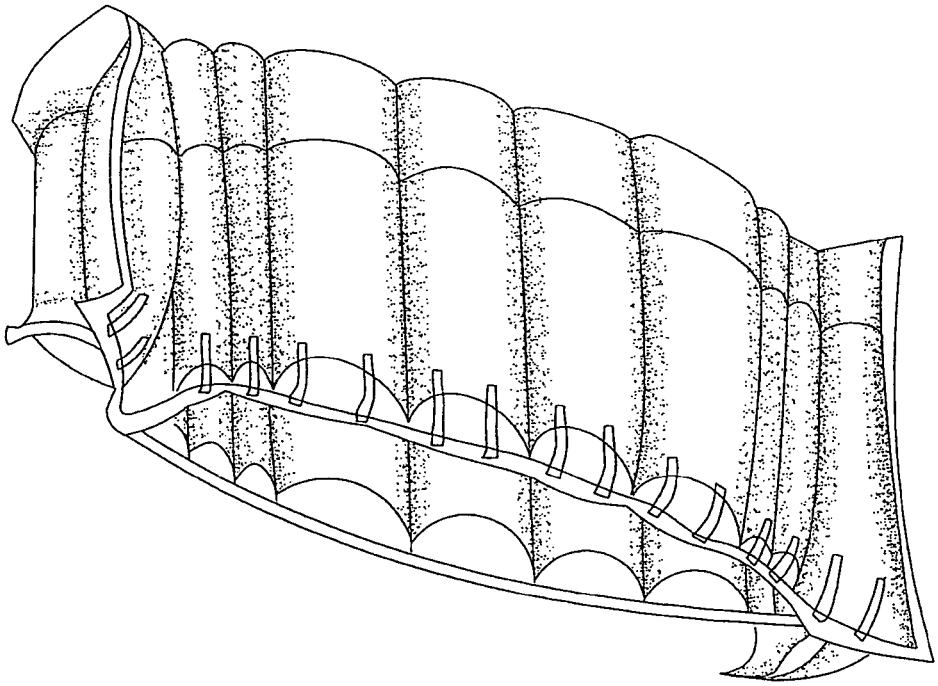
FIG. 10*a* is a perspective view of the air packaging device in accordance with the present invention, with the air packaging device filled with air.
Figure 10B:
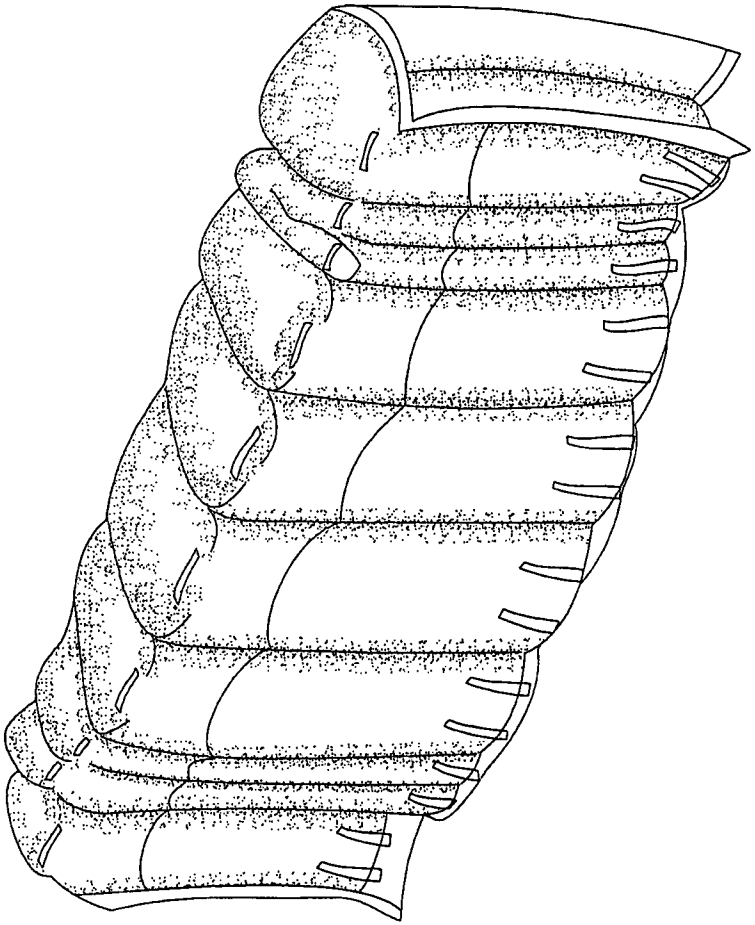
FIG. 10*b* is another perspective view of the air packaging device in accordance with the present invention, with the air.
Figure 11:
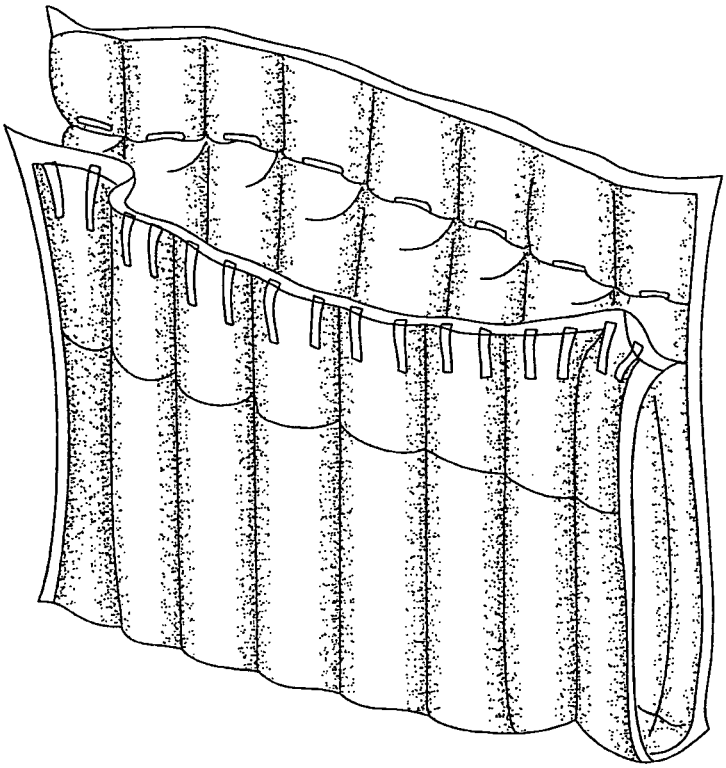
FIG. 11 is a perspective view of an air packaging device similar to the air packaging device in FIGS. 10*a* and 10*b*.

FIGS. 10*a* and 10*b* depict the air packaging device after being filled with air. FIG. 11 depicts an air packaging device similar to the one depicted in FIGS. 10*a* and 10*b*.

Figure 12:
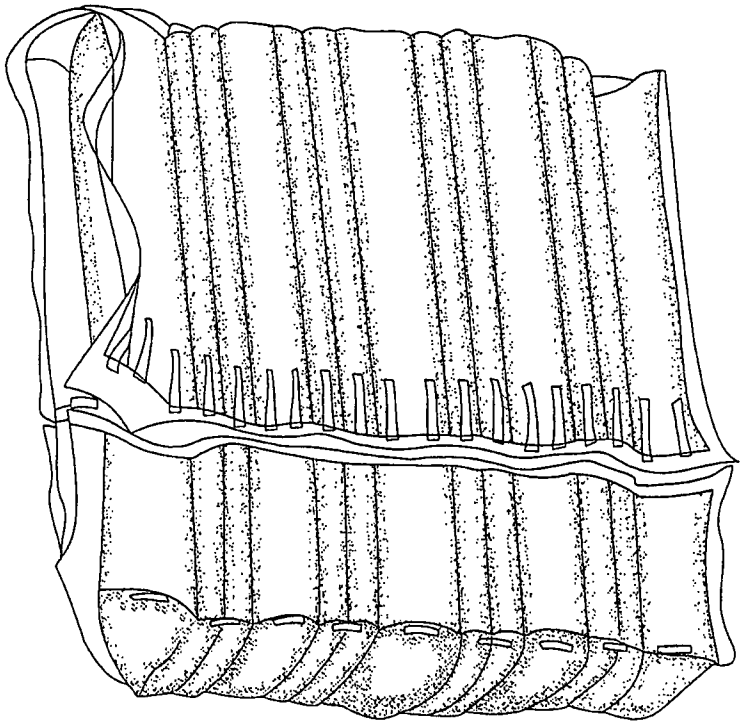
FIG. 12 is a perspective view of an air packaging device similar to the air packaging device in FIG. 11.

All of the embodiments of the air packaging device as aforementioned can be made into a wrapping bag with an open end as depicted in the above embodiments. As illustrated in FIGS. 10*a*, 10*b* and 11, the concurrent use of two same packaging devices can realize the cushioning protective function. In another example, the upper and lower parts of the semi-finished material are overlapped after the first step heat sealing process and then go through the second step heat sealing process to form a bag depicted in FIG. 12. In this way, only one packaging device is needed to have the cushioning protection.

The production method of the present invention of air packaging device employs first step and second step heat sealing processes, wherein the first step heat sealing process includes the following steps:

Use of the first heat sealing process to produce the semi-finished products having air chambers with a number of one-way valves, and the semi-finished products can be easily wound in rolls for future use; and Have the above semi-finished products undergone a heat sealing process again in one-step plastic packaging machine, further dividing some air chambers with multiple one-way valves into independent, small-diameter air chambers or connected spaces as required.

Finally, use the second step heat sealing process machinery to form the finished products.

As the air packaging devices are usually produced according to customers' orders without a large number of inventories, the production time will be very short after receiving the orders. At the same time, the production of the heat sealing process is relatively slow. The production time will be long if the materials are processed by the first heat sealing and the second heat sealing process in sequence, making it hard for workers who may have to work extra hours for production deadlines. By the production method of the present invention, semi-finished products may be prepared for universally standard large diameter air chambers with a number of one-way valves. When receiving orders, partition lines may be directly processed on the prefabricated semi-finished products, dividing the large air chamber into independent small air chambers or adding local heat plastic sealing transformations for local protection. Thus, preparations can be made in free time in between orders, and the production efficiency can be greatly improved when the production volume increases suddenly to greatly speed up the production of finished products. This will also make the production arrangement easy for the factory.

Applying the design of the above invention can produce functional packaging materials in various forms with light-proof, waterproof, moisture-proof, anti-wear, anti-compression, and shockproof properties, such as sealed bags and U-shaped bags. Meanwhile, features of plastic films can provide other features including anti-static, conductive, shock-cushioning, anti-wearing, anti-rusting and printable functions. Being different from the traditional air leakage-proof devices, the design of the present invention needs no external mechanical air stop device. Instead, relying on the specially treated internal and external functional films and by a series of simple local heat sealing processes, air can be kept in an enclosed space. According to this principle, a series of products and derivative products in relation to functional self-adhesive, non-reversible air blockage technology to form three dimensional packaging materials can be produced. Any change of product shape and function by changing the heat sealing shape, wrapping pattern, the heat sealing specifications and positions, by different cutting, or by selection of different plastic film features belong to the scope of the present invention, subject to the purpose of the present invention.

Deliberative but not limiting descriptions of the embodiments of the present invention have been made. However, it should be understood that the technical staff in this field may make changes and/or modifications without being away from the related scope of protection as defined in the Claims.

What is claimed is:

1. A method of producing an air packaging device, comprising the steps of:

(a) providing at least two layers of films;

(b) heat sealing said films to form a semi-finished product having a space defined between said two films for storing air, said space having a plurality of air chambers with a plurality of one-way valves;

(c) heat sealing said semi-finished product to further divide at least one of said air chambers, which has two or more one-way valves thereat, into two or more independent and small-diameter air chambers to form a finished products, wherein at least one of said air chambers has a diameter larger than said other air chambers to form a larger air chamber which has at least two said one-way valves which make said larger air chamber easy to fill with air, wherein each of said independent small-diameter air chambers has at least one said one-way valve communicating said independent small-diameter air chamber; wherein the step (c) further comprises a step of folding said semi-finished product and heat sealing along at least a heat sealing line to form a bag having a receiving cavity and an opening, wherein said receiving cavity defines two side air chambers and two middle air chambers between said two side air chambers, wherein two or more of said independent small-diameter air chambers form each of said side air chambers of said receiving cavity, wherein two or more of said independent large-diameter air chambers form each of said middle air chambers between said two side air chambers.

2. The method, as recited in claim 1, wherein, in the step (b), the semi-finished product is further heat sealed to form a main channel, wherein said main channel has an air inlet and is connected with each of said air chambers by at least one said one-way valve.

3. The method, as recited in claim 2, wherein, in the step (c), said larger air chamber is heat sealed to divide into two or more of said independent small-diameter air chambers, wherein said one-way valve at each of said independent small-diameter air chamber communicates with said main channel.

4. The method, as recited in claim 3 further comprising a step of heat sealing on said one-way valve of at least one of said independent and small-diameter air chamber to seal off said one-way valve of said independent and small-diameter air chamber from filling with air.

5. The method, as recited in claim 4, wherein said air chambers have different main diameters so that, after being filled with air, said air chambers with a larger main diameter and said air chamber with a smaller main diameter on the same surface form a wave-like shaped surface in such a manner that said air chambers with larger diameter are arranged in touch with an article received in said receiving cavity.

6. The method, as recited in claim 5, wherein, in the step (c), two said heat sealing lines are provided on both sides of said semi-finished product and are heat sealed to form said bag, .wherein said air chambers with larger diameter are positioned at both sides of said semi-finished product while said air chambers with smaller diameter are positioned in the middle of said semi-finished product.

7. The method, as recited in claim 6, wherein said larger air chamber to be heat sealed into said independent small-diameter air chambers is air chamber with larger diameter positioned at one of said sides of said semi-finished product.

8. The method, as recited in claim 4, wherein said heat sealing line is positioned between at least a side air chamber of said air chambers and an adjacent air chamber of said side air chamber of said air chambers in such a manner that, after said finished product is inflated with air, said side air chamber is inflated to form a side pressure air chamber to provide a lateral cushioning effect.

9. The method, as recited in claim 4, wherein, in the step (c), two said heat sealing lines are provided on both sides of said semi-finished product and are heat sealed to form said bag.

10. The method, as recited in claim 9, wherein said two heat sealing lines are positioned between at least two side air chambers of said air chambers and two adjacent air chambers of said two side air chambers of said air chambers respectively in such a manner that, after said finished product is inflated with air, said two side air chambers are inflated to form two side pressure air chambers respectively so as to provide a lateral cushioning effect at said both sides of said finished product.

11. The method, as recited in claim 3, wherein, in the step (c), two said heat sealing lines are provided on both sides of said semi-finished product and are heat sealed to form said bag.

12. The method, as recited in claim 11, wherein said two heat sealing lines are positioned between at least two side air chambers of said air chambers and two adjacent air chambers of said two side air chambers of said air chambers respectively in such a manner that, after said finished product is inflated with air, said two side air chambers are inflated to form two side pressure air chambers respectively so as to provide a lateral cushioning effect at said both sides of said finished product.

13. The method, as recited in claim 3, wherein said heat sealing line is positioned between a side air chamber of said air chambers and an adjacent air chamber of said side air chamber of said air chambers in such a manner that, after said finished product is inflated with air, said side air chamber is inflated to form a side pressure air chamber to provide a lateral cushioning effect.

14. The method, as recited in claim 1, further comprising a step of heat sealing on said one-way valve of at least one of said independent and small-diameter air chamber to seal off said one-way valve of said independent and small-diameter air chamber from filling with air.

15. The method, as recited in claim 1, wherein, in the step (c), two said heat sealing lines are provided on both sides of said semi-finished product and are heat sealed to form said bag.

16. The method, as recited in claim 15, wherein said two heat sealing lines are positioned between at least two side air chambers of said air chambers and two adjacent air chambers of said two side air chambers of said air chambers respectively in such a manner that, after said finished product is inflated with air, said two side air chambers are inflated to form two side pressure air chambers respectively so as to provide a lateral cushioning effect at said both sides of said finished product.

17. The method, as recited in claim 1, wherein said heat sealing line is positioned between at least a side air chamber of said air chambers and an adjacent air chamber of said side air chamber of said air chambers in such a manner that, after said finished product is inflated with air, said side air chamber is inflated to form a side pressure air chamber to provide a lateral cushioning effect.

18. The method, as recited in claim 1, wherein said air chambers have different main diameters so that, after being filled with air, said air chambers with a larger main diameter and said air chamber with a smaller main diameter on the same surface form a wave-like shape surface in such a manner that said air chambers with larger diameter are arranged in touch with an article received in said receiving cavity.

19. The method, as recited in claim 18, wherein, in the step (c), two said heat sealing lines are provided on both sides of said semi-finished product and are heat sealed to form said bag, wherein said air chambers with larger diameter are positioned at both sides of said semi-finished product while said air chambers with smaller diameter are positioned in the middle of said semi-finished product.

20. A method of producing an air packaging device, comprising the steps of:

(a) providing at least two layers of films;

(b) heat sealing said films to form a semi-finished product having a space defined between said two films for storing air, said space having a plurality of air chambers with a plurality of one-way valves; and (c) heat sealing said semi-finished product to further divide at least one of said air chambers, which has two or more one-way valves thereat, into two or more independent and small-diameter air chambers to form a finished products, wherein at least one of said air chambers has a diameter larger than said other air chambers to form a larger air chamber which has at least two said one-way valves which make said larger air chamber easy to fill with air, wherein each of said independent small-diameter air chambers has at least one said one-way valve communicating said independent small-diameter air chamber, wherein the step (c) further comprises a step of folding said semi-finished product and heat sealing along at least a heat sealing line to form a bag having a receiving cavity and an opening, wherein said receiving cavity defines two side air chambers and two middle air chambers between said two side air chambers, wherein two or more of said independent large-diameter air chambers form each of said side air chambers of said receiving cavity, wherein two or more of said independent small-diameter air chambers form each of said middle air chambers between said two side air chambers.

21. The method, as recited in claim 20, wherein, in the step (b), the semi-finished product is further heat sealed to form a main channel, wherein said main channel has an air inlet and is connected with each of said air chambers by at least one said one-way valve, wherein, in the step (c), said larger air chamber is heat sealed to divide into two or more of said independent small-diameter air chambers, wherein said one-way valve at each of said independent small-diameter air chamber communicates with said main channel.

22. The method, as recited in claim 21, further comprising a step of heat sealing on said one-way valve of at least one of said independent and small-diameter air chamber to seal off said one-way valve of said independent and small-diameter air chamber from filling with air, wherein said air chambers have different main diameters so that, after being filled with air, said air chambers with a larger main diameter and said air chamber with a smaller main diameter on the same surface form a wave-like shape surface in such a manner that said air chambers with larger diameter are arranged in touch with an article received in said receiving cavity.

23. The method, as recited in claim 20, wherein, in the step (c), two said heat sealing lines are provided on both sides of said semi-finished product and are heat sealed to form said bag, wherein said air chambers with larger diameter are positioned at both sides of said semi-finished product while said air chambers with smaller diameter are positioned in the middle of said semi-finished product.

24. The method, as recited in claim 23, wherein said larger air chamber to be heat sealed into said independent small-diameter air chambers is air chamber with larger diameter positioned at one of said sides of said semi-finished product.

25. The method, as recited in claim 24, wherein said heat sealing line is positioned between at least a side air chamber of said air chambers and an adjacent air chamber of said side air chamber of said air chambers in such a manner that, after said finished product is inflated with air, said side air chamber is inflated to form a side pressure air chamber to provide a lateral cushioning effect.

* * * * *